US008559661B2

(12) United States Patent
Tanghe

(10) Patent No.: US 8,559,661 B2
(45) Date of Patent: Oct. 15, 2013

(54) SOUND SYSTEM AND METHOD OF OPERATION THEREFOR

(75) Inventor: Loic Bernard Tanghe, Louvain (BE)

(73) Assignee: Koninklijke Philips N.V., Eindhoven (NL)

( * ) Notice: Subject to any disclaimer, the term of this patent is extended or adjusted under 35 U.S.C. 154(b) by 375 days.

(21) Appl. No.: 12/919,791

(22) PCT Filed: Mar. 5, 2009

(86) PCT No.: PCT/IB2009/050894

§ 371 (c)(1),
(2), (4) Date: Aug. 27, 2010

(87) PCT Pub. No.: WO2009/112980

PCT Pub. Date: Sep. 17, 2009

(65) Prior Publication Data

US 2011/0002468 A1 Jan. 6, 2011

(30) Foreign Application Priority Data

Mar. 14, 2008 (EP) ..... 08152748

(51) Int. Cl.
*H04R 5/02* (2006.01)

(52) U.S. Cl.
USPC ..... 381/303; 381/17; 381/80; 381/89; 381/97

(58) Field of Classification Search
USPC ..... 381/1, 2, 17, 300, 303, 120, 24, 28, 10, 381/15, 80, 101, 103, 98, 99, 97, 94.3, 18, 381/19, 20, 27, 77, 89, 332, 336, 301, 302, 381/304, 305, 307, 308
See application file for complete search history.

(56) References Cited

U.S. PATENT DOCUMENTS

| | | | | |
|---|---|---|---|---|
| 5,742,687 | A * | 4/1998 | Aarts | 381/1 |
| 5,870,484 | A * | 2/1999 | Greenberger | 381/300 |
| 6,169,812 | B1 | 1/2001 | Miller | |
| 6,175,489 | B1 | 1/2001 | Markow et al. | |
| 2001/0036286 | A1 | 11/2001 | Layton et al. | |
| 2002/0071574 | A1 | 6/2002 | Aylward et al. | |
| 2006/0078129 | A1 | 4/2006 | Nakamichi | |
| 2007/0263888 | A1 | 11/2007 | Melanson | |

FOREIGN PATENT DOCUMENTS

| | | | |
|---|---|---|---|
| EP | 0847225 | A2 | 6/1998 |
| EP | 1874083 | A1 | 1/2008 |
| WO | 9314607 | A1 | 7/1993 |
| WO | WO 9314607 | A1 * | 7/1993 |

* cited by examiner

*Primary Examiner* — Vivian Chin
*Assistant Examiner* — Leshui Zhang

(57) ABSTRACT

A sound system comprises at least three audio driver arrangements (101, 103, 105) for emitting audio signals. The audio driver arrangements (101, 103, 105) are angled relative to each other to emit sound signals in different directions angled at least 45° apart. A driving unit (201, 203, 205) is provided for each audio driver arrangement (101, 103, 105) to generate a drive signal. The audio driver arrangements (103, 105) angled most relative to each other are arranged to emit audio signals being between 90° and 270° out of phase. The driving arrangement (201) for the third audio driver arrangement (101) has a varying phase response with a variation resulting in the emitted audio signal varying between a first phase interval proximal the signal emitted from a first of the other audio driver arrangements (103) and a second phase interval proximal to the signal emitted from the second of the other audio driver arrangements (105). The invention may e.g. allow a reduced sensitivity to speaker and listening positions.

13 Claims, 1 Drawing Sheet

SOUND SYSTEM AND METHOD OF OPERATION THEREFOR

FIELD OF THE INVENTION

The invention relates to a sound system and a method of operation therefor, and in particular, but not exclusively, to reproduction of spatial multi-channel signals such as stereo or surround sound signals.

BACKGROUND OF THE INVENTION

Stereo reproduction of sound has for many years been popular for e.g. recorded music and other applications, and in recent years higher multi-channel sound reproduction with more than two channels has become increasingly popular, as for example evidenced by the popularity of surround sound systems. However, conventional multi channel sound reproduction has some inherent disadvantages and restrictions. For example, conventional systems require individual speakers for each channel with a location corresponding to the desired sound source location. However, it is typically impractical for the user to locate speakers at specific locations and it would be desirable to be able to provide multi-channel sound reproduction with reduced constraints on the speaker locations and/or from fewer locations and/or speakers.

Also, in order for a listener to experience a strong spatial sound reproduction, it is typically necessary for the listener to be located in a small area often referred to as the "sweet spot". For example, in order to experience the actual sound stage for a stereo reproduction it is required that the listener is located with equal distance to the two loudspeakers and preferably at a corner of an equilateral triangle formed by the listener and the two loudspeakers.

However, this is generally inconvenient or impractical as sound reproduction often is not performed in dedicated listening environments. For example, for consumer systems, the locations of the speakers and the listening points are typically determined by many other requirements such as room layout, location of furniture etc. Also, often a plurality of listening positions should be catered for such as e.g. when different listeners may be located at different locations (e.g. in different furniture located around a room).

In order to address such disadvantages, some products have been introduced to particularly use fewer speaker locations.

For example, it has been proposed to use omni-directional speakers which radiate equally in all directions resulting in a homogenous sound distribution in the room. Although this may allow a user increased freedom in positioning the speaker, it tends to result in a sound stage which is not wide. Indeed, such systems tend to produce a diffused sound which does not contain many strong spatial cues for the user thereby resulting in a degraded spatial experience.

It has also been proposed to process signals supplied to e.g. stereo speakers such that these will be experienced to originate from locations further apart than the locations of the stereo speakers. The processing of the signals is typically such that a total transfer function originating from the signal processing and the audio channel from the speaker to the listener will correspond to a virtual transfer function of an audio channel from a speaker located at the virtual positions. Thus, the virtual transfer function is estimated and used to determine the processing of the signals. However, although such an approach is able to create phantom or virtual sources (e.g. widely spaced speakers) and may attenuate the direct sound coming from the speakers, the result tends to be highly sensitive to variations in the transfer functions of the audio channels from the speakers to the listener. Accordingly, the approach is highly sensitive to variations in the listener's position and typically requires that the listener is located within a small sweet spot area.

It has furthermore been proposed to use speaker arrays wherein signals for a plurality of forward facing drivers are individually processed to generate a desired response at the listener. The processing of the signals is complex and typically includes audio beamforming algorithms, notch generation algorithms etc. Although, such speaker arrays and complex processing may provide advantageous performance in many embodiments, they also tend to be complex, costly and relatively large.

Hence, an improved sound system would be advantageous and in particular a sound system allowing increased flexibility, facilitated implementation, a reduced number of speaker locations and/or speakers, reduced size, reduced complexity, reduced cost, increased speaker location independence, increased listening location independence, increased sweet spot, a wider sound stage, an improved spatial perception and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided sound system for producing sound comprising: a first audio driver arrangement for emitting a first audio signal and having a first on-axis direction; a second audio driver arrangement for emitting a second audio signal and having a second on-axis direction, an angle between the first on-axis direction and the second on-axis direction being higher than 90°; a third audio driver arrangement for emitting a third audio signal and having a third on-axis direction; an angle between the first on-axis direction and the third on-axis direction being higher than 45° and an angle between the second on-axis direction and the third on-axis direction being higher than 45°; a first driving arrangement for generating a first drive signal for the first audio driver arrangement from a first signal, the first driving arrangement and the first audio driver arrangement together having a first phase response; a second driving arrangement for generating a second drive signal for the second audio driver arrangement from a second signal, the second driving arrangement and the second audio driver arrangement together having a second phase response; and a third driving arrangement for generating a third drive signal for the third audio driver arrangement from a second signal, the third driving arrangement and the third audio driver arrangement together having a third phase response and the firs signal, the second signal and the third signal comprising at least one common signal component; wherein the first phase response deviates from the second phase response by between 90° and 270° in a frequency interval above a first frequency; and the third phase response is a varying phase response with a variation between a first phase interval proximal to the first phase response and a second phase interval proximal to the second phase response.

The invention may allow improved performance in many embodiments. In particular, it may in many embodiments provide reduced sensitivity of the listening experience to speaker locations and/or listening locations. Specifically an increased sweet spot may typically be achieved.

The invention may allow an improved user experience and may in many applications result in a wider sound stage being perceived. In many embodiments, the invention may allow a wider sound stage perception than will be achieved from a conventional stereo speaker setup. In many embodiments, the invention may allow a wide sound image to be experienced in a large listening area. This may in particular be achieved from a reduced size sound system and especially a single speaker arrangement may be used requiring only a single speaker location to be provided.

Also, the invention may in many embodiments allow reduced size, complexity and/or cost.

The third phase response may be considered to be in a phase interval proximal to a given phase response if the difference in the phases between the two responses is less than a given threshold. The exact threshold may be dependent on the individual embodiments but particular advantageous performance may typically be achieved for a threshold of 20° and even more advantageous performance may typically be achieved for a threshold of 5°. Equivalently, the intervals may be defined relative to a phase difference to the most distant phase response. For example, the third phase response may be considered to be in the first interval if the phase difference to the second phase response exceeds a given threshold and in the second interval if the phase difference to the first phase response exceeds a given threshold. The threshold may for example be 30°, 90°, 120°, 145° or 170° depending on the preferences and requirements of the individual embodiment. The first and second phase intervals may specifically be non-overlapping and may typically differ by at least 45° for all frequencies.

The varying phase response may be from the first phase interval to the second phase interval and/or from the second phase interval to the first phase interval. The varying phase response comprises at least one transition between the first and second phase intervals.

In some embodiments, improved performance may be achieved for the angle between the first on-axis direction and the third on-axis direction being higher than 80° and/or the angle between the second on-axis direction and the third on-axis direction being higher than 80°.

In many embodiments, the third on-axis direction may halve the angle between the first on-axis direction and the second on-axis direction. In particular, the sound system may be arranged such that the first audio driver arrangement and the second audio driver arrangement are substantially symmetric around the third on-axis direction.

Improved performance may in many embodiments be achieved for a distance between audio drivers of the first and second audio driver arrangement of less than 50 cm or often more advantageously less than 30 cm.

The first frequency may specifically be 400 Hz or 800 Hz and/or the frequency interval may have a bandwidth of at least 1, 3 or 5 kHz.

In accordance with an optional feature of the invention, the phase variation comprises a frequency domain variation in the frequency interval.

This may in many embodiments allow improved performance and/or facilitated implementation and/or reduced complexity.

In accordance with an optional feature of the invention, the third phase response is within the first phase interval in at least a first frequency subinterval of the frequency interval and within the second phase interval in at least a second frequency subinterval of the frequency interval.

This may in many embodiments allow improved performance and/or facilitated implementation and/or reduced complexity.

The first frequency subinterval and the second frequency subinterval may specifically each have a minimum bandwidth of at least 200, 400, 800 Hz and/or a maximum bandwidth of 500Hz, 1 kHz or 3 kHz.

In some embodiments, the third phase response has a phase difference of less than 20° with respect to the first phase response within at least a first frequency subinterval of the frequency interval and a phase difference of less than 20° with respect to the second phase response within at least a second frequency subinterval of the frequency interval.

In accordance with an optional feature of the invention, the third phase response has a minimum of two transitions between the first phase interval and the second phase interval within the frequency interval.

This may allow improved performance. In particular, it may allow an increased spatial perception and/or an increased independence on speaker and/or listening position.

In accordance with an optional feature of the invention, the third phase response has a maximum of six transitions between the first phase interval and the second phase interval within the frequency interval.

This may allow improved performance and may e.g. reduce perceived audio quality degradation. In particular, it may allow an improved trade off between perceived audio quality and increased spatial perception and/or an increased independence on speaker and/or listening position.

In accordance with an optional feature of the invention, the third driving arrangement comprises at least one all-pass filter having a frequency varying phase response.

This may in many embodiments allow improved performance and/or facilitated implementation and/or reduced complexity.

In accordance with an optional feature of the invention, the phase variation comprises a time domain variation.

This may in many embodiments allow improved performance and/or facilitated implementation and/or reduced complexity. In particular, it may in many embodiments allow a facilitated phase variation and/or an improved audio quality perception.

In some embodiments the phase variation may comprise both a time domain variation and a frequency domain variation.

In accordance with an optional feature of the invention, the sound system further comprises means for generating the first signal from only a first signal of a stereo signal, the second signal from only a second signal of the stereo signal, and the third signal from both the first and second signal of the stereo signal.

This sound system may provide improved stereo signal reproduction. In particular, a wider sound image may be provided and/or an increased speaker and/or listening position independence for perception of a stereo signal may be achieved. The feature may furthermore allow an improved stereo image to be generated and may specifically allow stereo characteristics from the received signal to be increasingly retained in the generated sound signal.

The third signal may specifically be generated as an average or (scaled or weighted) sum of the first and second signals from the stereo signal. In particular, the third signal may be generated as the mono component of the received stereo signal.

In some embodiments, the sound system may comprise means for generating the first signal from only signals for one side in a surround signal, the second signal from only signals for another side in the surround signal, and the third signal from at least one center signal of the surround signal.

This sound system may thus provide improved reproduction of a surround sound signal.

In accordance with an optional feature of the invention, the first phase response and the second phase response are such that common signal components of the first audio signal and the second audio signal are substantially out of phase.

This may in many embodiments allow improved performance and/or facilitated implementation and/or reduced complexity.

In many scenarios advantageous performance may be achieved if common signals are at least between 90° and 270° out of phase and even more advantageous performance may often be achieved if common signals are at least between 170° and 190° out of phase.

In accordance with an optional feature of the invention, a difference between the first phase response and the second phase response is below 45° for frequencies below a second frequency, the second frequency being lower than the first frequency.

This may in many embodiments allow improved performance and/or facilitated implementation and/or reduced complexity. In particular, it may allow an increased sound level to be generated for lower frequencies. The feature may for example improve bass sounds and/or reduce the requirement for a subwoofer.

The second frequency may in many scenarios advantageously be 200Hz, 400 Hz or 600 Hz.

In accordance with an optional feature of the invention, a difference between the first phase response and the third phase response is below 45° for frequencies below the second frequency.

This may in many embodiments allow improved performance and/or facilitated implementation and/or reduced complexity. In particular, it may allow an increased sound level to be generated for lower frequencies. The feature may for example improve bass sounds and/or reduce the requirement for a subwoofer.

The second frequency may in many scenarios advantageously be 200Hz, 400 Hz or 600 Hz.

In accordance with an optional feature of the invention, a gain response of at least one of the first driving arrangement and the second driving arrangement comprises an increasing gain for increasing frequency in at least one frequency interval above a frequency of 2 kHz.

This may in many embodiments allow improved performance and/or facilitated implementation and/or reduced complexity. In particular, it may allow improved directional cues to be provided to a listener from the first and second audio driver arrangement and may specifically in many embodiments allow improved spatial cues to be provided via reflected sideways radiated sound signals from the first and second audio driver arrangement.

The at least one frequency interval may have a bandwidth of at least 1 kHz, 2 kHz or 3 kHz.

In accordance with an optional feature of the invention, at least one of the first audio driver arrangement and the second audio driver arrangement comprises a plurality of driver units.

This may in many embodiments allow improved performance and/or facilitated implementation and/or reduced complexity. E.g., this may allow an increased sound level being radiated for sideways directed audio signals than for forward directed audio signals.

Each driver unit may correspond to an individual loudspeaker unit or audio transducer unit.

The number of driver units in at least one of the first audio driver arrangement and the second audio driver arrangement may exceed the number of driver units in the third audio driving arrangement.

In accordance with an optional feature of the invention, the third audio driver arrangement comprises a plurality of driver units.

This may in many embodiments allow improved performance and/or facilitated implementation and/or reduced complexity. For example, it may allow a central audio signal to be directed towards a listening position without requiring the central position of an enclosure being allocated to driver units. For example, it may allow a centrally located display to be included while still allowing a central sound signal being radiated.

According to another aspect of the invention, there is provided method of operation for sound system for producing sound, the method comprising: a first audio driver arrangement emitting a first audio signal and having a first on-axis direction; a second audio driver arrangement emitting a second audio signal and having a second on-axis direction, an angle between the first on-axis direction and the second on-axis direction being higher than 90°; a third audio driver arrangement emitting a third audio signal and having a third on-axis direction; an angle between the first on-axis direction and the third on-axis direction being higher than 45° and an angle between the second on-axis direction and the third on-axis direction being higher than 45°; a first driving arrangement generating a first drive signal for the first audio driver arrangement from a first signal, the first driving arrangement and the first audio driver arrangement together having a first phase response; a second driving arrangement generating a second drive signal for the second audio driver arrangement from a second signal, the second driving arrangement and the second audio driver arrangement together having a second phase response; and a third driving arrangement generating a third drive signal for the third audio driver arrangement from a second signal, the third driving arrangement and the third audio driver arrangement together having a third phase response and the first signal, the second signal and the third signal comprising at least one common signal component; wherein the first phase response deviates from the second phase response by between 90° and 270° in a frequency interval above a first frequency; and the third phase response is a varying phase response with a variation between a first phase interval proximal to the first phase response and a second phase interval proximal to the second phase response.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to sound reproduction for a stereo signal. However, it will be appreciated that the invention is not limited to this application but may be applied to sound reproduction for many other types of signals including for example mono or surround sound signals.

Figure 1:
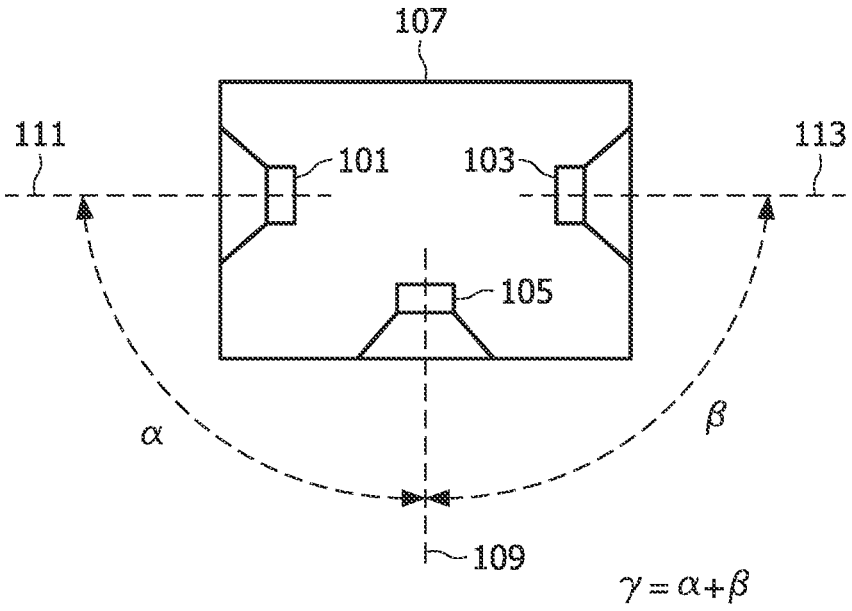
FIG. 1 illustrates and example of a speaker arrangement in accordance with some embodiments of the invention.

FIG. 1 illustrates and example of a speaker arrangement in accordance with some embodiments of the invention. In the example, three drivers 101, 103, 105 are mounted within an enclosure 107. Each of the drivers may specifically be a loudspeaker or any other sound transducer that can generate an audio signal from a provided (electrical) signal. In the example, the three drivers 101, 103, 105 are substantially identical (i.e. they are all the same type of speaker and only vary due to manufacturing variations and tolerances). However, it will be appreciated that in other embodiments, different types of drivers may be used.

In the example, the drivers 101, 103, 105 are angled with respect to each other such that they radiate sound signals in different directions (i.e. their audio beam is angled relative to each other). Specifically, each driver 101, 103, 105 has an on-axis direction 109, 111, 113 and the drivers 101, 103, 105 are arranged such that the on-axis directions 109, 111, 113 are angled relative to each other.

The on-axis direction of a driver may specifically be a symmetric radiation axis. For example, a driver may be rotationally invariant or symmetric around the on-axis direction. The on-axis direction may be the direction of highest sound output of the driver. Thus, the on-axis direction may correspond to the direction in which the maximum sound energy is radiated. The on-axis direction may specifically be defined by an axis through a centre of the driver.

In the specific example, a third driver 105 is arranged centrally and the other two drivers 101, 103 are arranged symmetrically around the on-axis direction 109 of the third driver 105. In a use scenario the third driver 105 will be a central driver which often will be directed towards a nominal listening position. Thus the third driver 105 may specifically be a front firing driver and may have its acoustic centre in the centre of the enclosure 107. Thus, typically, the third driver 105 will be considered a forward facing speaker for the speaker arrangement.

In the example, the two other drivers 101, 103 are mounted in a sideways configuration such that they emit audio signals substantially sideways. Thus, in the example, the angles $\alpha$ and $\beta$ between the on-axis direction 109 of the third driver 103 and the on-axis directions 111,113 of the first and second driver 101, 103 respectively are substantially 90° and the angle $\alpha+\beta$ between the on-axis directions 111,113 of the first and second driver 101, 103 is substantially 180°. However, it will be appreciated that in other embodiments other configurations may be used and that the advantages of the described speaker arrangement can be found for other angles.

Specifically, it has been found that advantageous performance can be found if each of the angles $\alpha$ and $\beta$ are at least 45°. It has also been found that improved performance is found for angles of $\alpha$ and $\beta$ of less than 135°. Indeed in many embodiments, improved performance is achieved for angles $\alpha$ and $\beta$ between 65° and 115° and in particular between 80° and 110°.

It will be appreciated that in the specific example, a symmetric configuration is used resulting in $\alpha$ being equal to $\beta$. However, it will be appreciated that in other embodiments, a non symmetrical configuration may be used such that $\alpha$ and $\beta$ may have different values. However, such configurations will be arranged such that both $\alpha$ and $\beta$ will exceed 45° and thus the angle $\alpha+\beta$ between the on-axis directions 111, 113 will exceed 90°.

In the arrangement, the distance between the drivers 101, 103, 105 is kept low and in particular the distance between the drivers 101, 103, 105 is kept below 50 cm. Specifically, the distance between the outer drivers 101, 103 is kept below 50 cm and in many embodiments below 30 cm.

This results in any differences in the path lengths of the audio paths from the drivers 101, 103, 105 to a listener being significantly less than the wavelength of the audio signal. As a consequence, the phase differences caused by the differences in the path lengths can be kept relatively low. Specifically, the small distances may allow the drivers 101, 103, 105 to be considered as a single location audio source rather than a distributed audio source. Specifically, it may allow the outer drives 101, 103 to operate as an audio dipole.

Thus the described speaker arrangement allows a single box speaker system 107 to radiate sound signals in different directions. Specifically different drivers 101, 103, 105 are used to radiate sound forwards and sideways thereby allowing sound to be received both directly and reflected of surfaces in the acoustic environment in which the system is placed.

In the example, dedicated sound processing is used for each driver 101-105 in order to allow the directional characteristics of the speaker arrangement to be used to provide a number of advantages in many listening scenarios.

Figure 2:
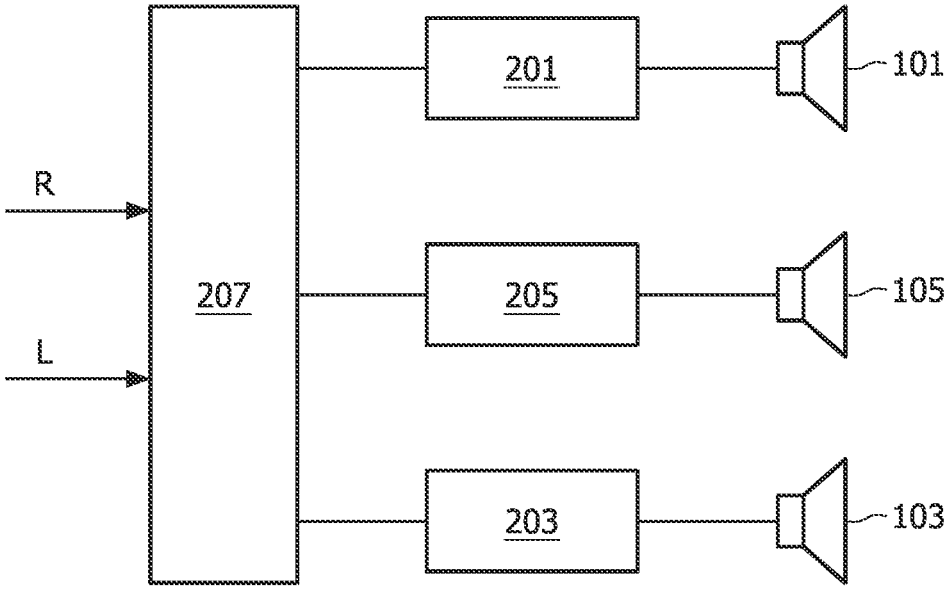
FIG. 2 illustrates and example of a sound system in accordance with some embodiments of the invention.

FIG. 2 illustrates an example of a sound system using the speaker arrangement of FIG. 1. In the example, the first driver 101 is coupled to a first driving unit 201 which generates a first drive signal for the first driver 101 from a first driving unit input signal, the second driver 103 is coupled to a second driving unit 203 which generates a second drive signal for the second driver 103 from a second driving unit input signal, and the third driver 105 is coupled to a third driving unit 205 which generates a third drive signal for the third driver 101 from a third driving unit input signal.

Each driving unit 201-205 may be any driving unit capable of generating a suitable drive signal for an audio transducer. Each driving unit 201-205 may specifically comprise analogue and/or digital functionality for processing signals. In the specific example, each driving unit 201-205 comprises digital signal processing functionality for executing signal processing algorithms as well as a digital to analogue converter which is arranged to convert the resulting drive signal to the analogue domain. The analog signal may then be amplified in a suitable audio amplifier part of the driving unit 201-205.

In the example, the sound system is arranged to reproduce sound from a stereo signal and the three driving units 201-205 are coupled to a stereo processor 207 which is arranged to receive a stereo signal comprising a right channel R and the left channel L and to generate the three input signals for the driving units 201-205.

In the example, the stereo signal is received as a digital sampled (non-encoded) PCM (Pulse Code Modulated signal) and the stereo processor 207 generates PCM signals that are fed to each of the driving units 201-205.

The stereo processor 207 specifically generates the first driving unit input signal for the "left" sideways driver 101 as the received left stereo signal and the second driving unit input signal is generated for the "right" sideways driver 103 as the received right stereo signal. Furthermore the third driving unit input signal generated for the central third driver 105 is generated as a combination of the left and right received stereo signals and specifically is generated as the summation of these two signals. Thus the input signals for the driving units 201-205 are generated as:

$$s_1=L$$

$$s_2=R$$

$$s_3=\tfrac{1}{2}(L+R)$$

It will be appreciated that in other embodiments other approaches of generating the three driving unit input signals from a stereo signal may be used. However, in the described example, the first driving unit input signal is generated in response to only a first channel of the stereo signals and will be independent of the second channel of the stereo signal, whereas the second driving unit input signal is generated in response to only the second channel and is independent of the first channel. Thus each stereo channel contributes to the driving signals of only one of the sideways mounted drivers 101, 103. In contrast, the driving signal for the central third driver 105 comprises contributions from both channels of the stereo signal.

Each of the driving paths consisting of a driver 101-105 and associated driving unit 201-205 has an associated transfer function that characterizes how the emitted audio signal relates to the driving unit input signal for the path. The transfer function can be characterized by an amplitude response and a phase response which may be both time and frequency dependent.

In the sound system of FIG. 2, the phase responses of each path is carefully controlled such that they in combination with each other and the physical driver configuration of the speaker arrangement of FIG. 1 provide a number of advantageous effects.

It will be appreciated that in many embodiments substantially identical drivers will be used and accordingly the phase response of each driver will be substantially the same. Accordingly, the phase response of the drivers may in many embodiments be ignored and the phase responses differences between the paths will be determined by the phase responses of the driving units only.

For brevity and clarity, the following description will focus on an embodiment wherein the drivers 101-105 are substantially identical and it will be assumed that they have only insignificant phase response (and amplitude) differences. Accordingly, the driver phase responses can be ignored and the path phase response will be considered to be controlled only by the corresponding drive unit phase response. However, it will be appreciated that in embodiments wherein such assumptions are not appropriate, the phase responses resulting from the driving unit 201-205 and the driver 101-105 together will be considered. Specifically, the phase response of each driving unit 201-205 may be compensated for measured phase response differences of the drivers 101-105.

In the system, the first driving unit 201 and the second driving unit 203 are arranged to have phase responses which differ by between 90° and 270° in a frequency interval above a first frequency. The first frequency may specifically be a frequency that results in a phase difference being present for most frequencies for which the listener typically perceives a direction of sound. For example, the first frequency may be in the interval from 200 Hz to 800 Hz. Furthermore, the frequency interval may be sufficiently large to include most frequencies which are typically audible and provide directional cues.

As a specific example, the first frequency interval may be at least 1 kHz-4 kHz thereby ensuring that the phase difference is present in an interval which provides most of the directional cues to a listener. In many embodiments, improved performance may be achieved by ensuring that the frequency difference holds in a larger frequency range. For example, in many embodiments, the frequency range may be at least from 800 Hz-5 kHz.

In many embodiments, the first and second phase response of the first and second driving units 201, 203 respectfully are arranged to be substantially out of phase. For example, the phase difference between the phase responses may be between 170° and 190° within the frequency interval.

It will be appreciated that the first and second phase responses may typically be time-invariant and may accordingly meet the phase difference requirement at all times. However, in some embodiments, the phase responses may be time varying and may possibly only meet the requirement most of the time. For example, the requirement may be met at least 70%, 90% or 95% of the time resulting in improved sound reproduction for most of the time.

In the system of FIG. 2, the third phase response of the third driver 205 is a varying phase response with a variation between a first phase interval proximal to the first phase response and a second phase interval proximal to the second phase response. Thus, the emitted audio signal from the central third driver 105 varies from being close to the signal from the first driver 101 and remote from the signal from second driver 103 to being close to the signal from the second driver 103 and remote from the signal from first driver 101 (and/or vice versa).

The phase response variation of the third driving unit 205 may be provided in the frequency domain and/or in the time domain. The following description focuses on phase variations in the frequency domain.

Thus, in such an example the phase response of the third driving unit varies from being close to the phase response of the first driving unit 201 at some frequencies to being close the phase response of the second driving unit 203 at other frequencies.

In the system, the three driving unit input signals are generated from a stereo signal and are generally not identical. However, they contain at least some common signal components. For example, for music representation, instruments included in the middle of the sound stage will be present in all three driving unit input signals and will thus also be represented in the emitted audio signals of all three drivers 101-105. However, the phase of the emitted audio signals will be different such that the sideways emitted sounds of this instrument will be out of phase with each other whereas the phase of the centrally emitted sound will depend on the frequencies of the instrument and will typically include a range of different phases.

Thus in the system, the sideways drivers 101, 103 are provided with substantially out-of-phase signals and the centre driver 105 is provided with a phase varying signal so that it will be in phase with the left driver (and out-of-phase with the right driver) at some frequencies, and in phase with the right driver (and out-of phase with the left driver) at other frequencies.

In the setup, the sideways drivers 101, 103 form a dipole. This results in a very spacious sound when the listener is directly in front of the speaker arrangement. However, the effect may be very strong and is focused on a relatively small area in front of the speaker arrangement. However, the presence of the centre driver 105 will dilute the dipole effect of the sideways drivers 101, 103 and will also create other dipoles at different frequencies depending on the phase at the different frequencies. This may result in a substantially increased sound space experienced in a wider listening area.

Thus, the phase variation between different emitted audio signals together with the physical configuration of the speaker arrangement can provide a number of advantages. Specifically, it provides a more diffused sound which can provide the perception of an increased sounds space (e.g. due to reflections). Furthermore, the system may provide an increased sensitivity to the speaker and listening position. In particular, a spacious sound stage may be provided to users in a wide listening area.

In the specific example of stereo reproduction, the left and right drivers are not arranged to be exactly out-of-phase in the frequency interval. Rather the left driver 101 is fed the left stereo input signal and the right driver 103 is fed a reversed phase right stereo input signal. Most of the sound energy (such as lead voice or lead instruments) is usually the same on left and right stereo signals and therefore the left and right drivers 101, 103 are mostly forming a dipole.

However, any "panned" signals in the original stereo signal (e.g. a guitar mostly appearing in the right stereo channel) will remain in the corresponding location in the final perceived sound stage thereby providing an improved stereo effect.

Thus, the system allows the perception of a wide sound stage from a compact, single box speaker arrangement. Although, stereo perception may be reduced with respect to some full stereo setups this will in many scenarios be perfectly acceptable in view of the improved wide sound image available to a listener a large listening area.

Specifically, the sound system may sound as if it is much larger than the limited physical dimensions required to implement the speaker arrangement. Furthermore, there is no requirement for the listener to be located directly in front of the speaker. Thus, the system provides increased freedom of placement in a listening environment. E.g. the system can be placed against a wall, in a corner or in the middle of the room. The system also provides increased freedom for the listener to move in the listening environment or allows an increased number of listeners or listening positions to be catered for. In addition, the system has small physical dimensions, has a low complexity and can be manufactured at low cost.

It will be appreciated that the phase variation of the third driving unit 105 may be different in different embodiments. For example, in some embodiments, the variation may be such that a proximal phase interval is within 20° of the reference phase response whereas in other embodiments a proximal phase interval may be within 5° of the reference phase response. Indeed, in many embodiments, the phase variations are arranged to ensure that at some frequencies the phase difference between the phase response of the third driving unit 105 and the most different phase response of the first or second driving unit 101, 103 exceeds a given amount. For example, the phase variation may be such that the third phase response varies from being more than a given amount away from the first phase response to being more than a given amount away from the second phase response. This value may for example be 60°, 90°, 120°, 150° or 170° depending on the specific requirements of the specific embodiment.

In the specific embodiment, wherein the phase variation is performed in the frequency domain, the phase variation is such that the third phase response is within the first phase interval (proximal to the first phase response) in at least a first frequency subinterval and within the second phase interval (proximal to the second phase response) in at least a second frequency subinterval.

Thus, for the frequency interval in which the phase variation is introduced, the third phase response has at least one transition from a frequency interval where it is close to a phase response of one of the side drivers 101, 103 to a frequency interval where it is close to a phase response of the other of the side drivers 101, 103.

The number of phase transitions occurring within the frequency interval may have a significant effect on the resulting sound perception. In particular, for fewer transitions the advantages obtained by the phase variation tends to reduce and the effects become less significant. Furthermore, for an increasing number of transitions, the perception of the generated sounds tend to become degraded and especially the listener may start to perceive artifacts introduced by the phase variations (in other words the phase variation itself may start to become noticeable).

A large number of experiments have been performed and has demonstrated that in many scenarios and applications improved performance is achieved when the third phase response has a minimum of two transitions. Likewise, the experiments have demonstrated that improved performance is achieved when the third phase response has a maximum of six transitions.

It will be appreciated that any suitable way of controlling and providing the desired phase response variation may be used. For example, the third driving unit 205 can include a Discrete Fourier Transform that converts the driving unit input signal to the frequency domain. The phase of each resulting bin may then be modified to generate the phase variation (e.g. by a complex multiplication). The resulting signal may then be converted back to the time domain and converted to the analog domain for provision to the third driver 105.

In the specific example, the third driving arrangement comprises at least one all-pass filter having a frequency varying phase response. In particular, the driving arrangement may comprise a cascade of $1^{st}$ order all-pass filters designed such that the centre driver 105 is alternatively in or out-of phase with the left and right drivers 101, 103 at different frequencies. This may allow an efficient yet low complexity introduction and control of the desired phase variation.

In some embodiments, the phase variation may alternatively or additionally be performed in the time domain. For example, the filter characteristics of the all-pass filter(s) of the third driving unit 205 may be dynamically changed in time. As another example, the phase response of the third driving unit 205 may be dynamically varied in time by introducing a small time varying delay.

In some applications and scenarios, an additional or alternative time domain variation may provide improved performance and allow an improved user experience. Also, in some embodiments, the time domain variation may be easier to introduce.

In some embodiments, the operation of the driving units 201-205 is different at low frequencies than at high frequencies. Specifically, the driving units 201-205 may be arranged to generate signals that result in the emitted sound signals being more in-phase at low frequencies.

For example, the first and second driving units 201, 203 may be arranged such that a difference between the first phase response and the second phase response is below 45° for frequencies below a given frequency. Indeed in some embodiments, the phase difference is kept below 20° or even 10° for lower frequencies.

Similarly, the third driving unit 205 is arranged such that a difference between the first phase response and the third phase response is below 45° for frequencies below the given frequency. Indeed in some embodiments, the phase difference is kept below 20° or even 10° for lower frequencies.

By ensuring that the emitted audio signals are more in phase at lower frequencies, it can be achieved that the emitted sound signals from the three drivers 101-105 add up (more) coherently at the listening position thereby providing an increased sound pressure level.

Specifically, lower frequencies tend to not comprise perceptible directional cues and do not provide any significant spatial effect (a listener effectively cannot hear where low frequency sound is coming from) and therefore the optimization for lower frequencies may be aimed at providing higher sound pressure levels.

The given frequency below which the emitted sound signals are aligned in phase rather than separated (as for higher frequencies) will depend on the preferences and characteristics of the individual embodiment and application. However, in many scenarios improved performance is achieved for a frequency of 400 Hz. In some applications, particularly advantageous performance is achieved for a frequency of between 200 Hz and 800 Hz.

In some embodiments, the gain response of at least one of the first and second driving units 201, 203 comprises an increasing gain for increasing frequencies in at least one frequency interval above a frequency of 2 kHz. The frequency interval may cover a frequency range of at least 2-5 kHz.

Specifically, each of the driving units 201, 203 for the sideways drivers 101, 103 may comprise functionality for providing a boost to high frequencies. For example, each of the driving units 201, 203 can contain a high pass filter which increases the gain for frequencies above 3 kHz.

This may provide improved performance in many applications and may in particular provide increased emphasis of frequencies which are most suitable for being reflected to generate sideways directional cues. Thus, an improved spatial experience may be achieved.

It will be appreciated that although the previous description focused on only a single driver being used for each direction of radiated sound ways, a plurality of drivers may in other embodiments be used.

For example, in some embodiments one or both of the sideways arrangements may comprise a plurality of driver units. For example, rather than a single loudspeaker, each of the sideways mounted arrangements may comprise two or more speakers angled in the same direction.

In a typical use scenario, the sideways configured drivers 101, 103 need to radiate more audio power than the centre driver 105 and this may be facilitated by the use of more drivers radiating in the same direction.

In some embodiments, the forward facing speaker arrangement may comprise a plurality of driver units. Thus, the single center driver 105 may in some embodiments be replaced by a plurality of drivers angled in the forward direction. This may e.g. provide additional flexibility in the placement of the individual driver units. For example, the centre driver 105 may be replaced by two drivers with some space in between thereby allowing the enclosure 107 to also include a component that needs to be in the centre, such as a e.g. a display.

It will be appreciated that although the described embodiment focused on reproduction from a stereo signal, the described principles may also be applied to other types of signals.

For example, a mono signal may be provided as the input signal to all three driving units 201-205 resulting in the generation of the same signal being transmitted out of phase by the sideways drivers 101, 105 and with a varying phase from the centre driver 105. This may provide an enhanced listening experience as a distributed sound stage and/or diffused sound may be experienced from a simple mono signal.

As another example, the sound system may be used to reproduce a surround sound signal. For example, a surround sound processor may replace the stereo processor of FIG. 2 and generate the first driver unit input signal as the sum of the left front signal and the left rear signal, the second driver unit input signal as the sum of the right front signal and the right rear signal, and the third driver unit input signal as the centre front signal.

It will be appreciated that although not explicitly described in the above, the processing of the signals may included suitable volume adjustment, amplification, conversion between analogue and digital domains, transforms between the frequency and time domain etc.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A sound system for producing sound comprising:

a first audio driver configured to emit a first audio signal in response to a first drive signal, the first audio signal having a first on-axis direction;

a second audio driver configured to emit a second audio signal in response to a second drive signal, the second audio signal having a second on-axis direction, an angle between the first on-axis direction and the second on-axis direction being higher than 90°;

a third audio driver configured to emit a third audio signal in response to a third drive signal, the third audio signal having a third on-axis direction, an angle between the first on-axis direction and the third on-axis direction being higher than 45°, and an angle between the second on-axis direction and the third on-axis direction being higher than 45°;

a first driving unit configured to generate the first drive signal for the first audio driver from a first driving unit input signal, wherein the first driving unit and the first audio driver together comprise a first driving path with an associated first transfer function having a first phase response;

a second driving unit configured to generate the second drive signal for the second audio driver from a second driving unit input signal, the second driving unit and the second audio driver together comprise a second driving path with an associated second transfer function having a second phase response; and a third driving unit configured to generate the third drive signal for the third audio driver from a third driving unit input signal, the third driving unit and the third audio driver together comprise a third driving path with an associated third transfer function having a third phase response, wherein the first driving unit input signal, the second driving unit input signal and the third driving unit input signal comprise at least one common signal component;

wherein the first phase response deviates from the second phase response by between 90° and 270° in a frequency interval above a first frequency; and wherein the third phase response of the third transfer function comprises a phase response that varies with a variation, provided in a frequency domain, of a minimum of two transitions between (i) a first phase interval proximal to the first phase response of the first transfer function within the frequency interval above the first frequency and (ii) a second phase interval proximal to the second phase response of the second transfer function within the frequency interval above the first frequency.

2. The sound system of claim 1, wherein the third phase response is (i) within the first phase interval in at least a first frequency subinterval of the frequency interval and (ii) within the second phase interval in at least a second frequency subinterval of the frequency interval.

3. The sound system of claim 1, wherein the third phase response has a maximum of six transitions between (i) the first phase interval and (ii) the second phase interval within the frequency interval.

4. The sound system of claim 1, wherein the third driving unit comprises at least one all-pass filter having a frequency varying phase response.

5. The sound system of claim 1, wherein the variation further comprises a variation provided in a time domain.

6. The sound system of claim 1, further comprising:

means for generating (i) the first driving unit input signal from only a first signal of a stereo signal, (ii) the second driving unit input signal from only a second signal of the stereo signal, and (iii) the third driving unit input signal from both the first and second signals of the stereo signal.

7. The sound system of claim 1, wherein the first phase response and the second phase response are such that common signal components of the first audio signal and the second audio signal are substantially out of phase.

8. The sound system of claim 1, wherein a difference between the first phase response and the second phase response is below 45° for frequencies below a second frequency, the second frequency being lower than the first frequency.

9. The sound system of claim 8, wherein a difference between the first phase response and the third phase response is below 45° for frequencies below the second frequency.

10. The sound system of claim 1, wherein a gain response of at least one of the first driving unit and the second driving unit comprises an increasing gain for increasing frequency in at least one frequency interval above a frequency of 2 kHz.

11. The sound system of claim 1, wherein at least one of the first audio driver and the second audio driver comprises a plurality of audio drivers.

12. The sound system of claim 1, wherein at the third audio driver comprises a plurality of audio drivers.

13. A method of operation for sound system for producing sound, the method comprising:

emitting, via a first audio driver in response to a first drive signal, a first audio signal and having a first on-axis direction;

emitting, via a second audio driver in response to a second drive signal, a second audio signal and having a second on-axis direction, an angle between the first on-axis direction and the second on-axis direction being higher than 90°;

emitting, via a third audio driver in response to a third drive signal, a third audio signal and having a third on-axis direction, an angle between the first on-axis direction and the third on-axis direction being higher than 45°, and an angle between the second on-axis direction and the third on-axis direction being higher than 45°;

generating, via a first driving unit, the first drive signal for the first audio driver from a first driving unit input signal, the first driving unit and the first audio driver together comprise a first driving path with an associated first transfer function having a first phase response;

generating, via a second driving circuit, the second drive signal for the second audio driver from a second driving unit input signal, the second driving unit and the second audio driver together comprise a second driving path with an associated second transfer function having a second phase response; and generating, via a third driving circuit, the third drive signal for the third audio driver from a third driving unit input signal, the third driving unit and the third audio driver together comprise a third driving path with an associated third transfer function having a third phase response, wherein the first driving unit input signal, the second driving unit input signal and the third driving unit input signal comprise at least one common signal component;

wherein the first phase response deviates from the second phase response by between 90° and 270° in a frequency interval above a first frequency; and wherein the third phase response of the third transfer function comprises a phase response that varies with a variation, provided in a frequency domain, of a minimum of two transitions between (i) a first phase interval proximal to the first phase response of the first transfer function within the frequency interval above the first frequency and (ii) a second phase interval proximal to the second phase response of the second transfer function within the frequency interval above the first frequency.

* * * * *